US009260857B2

(12) United States Patent
Hohmann, Jr.

(10) Patent No.: US 9,260,857 B2
(45) **Date of Patent: *Feb. 16, 2016**

(54) FAIL-SAFE ANCHORING SYSTEMS FOR CAVITY WALLS

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/828,962

(22) Filed: Mar. 14, 2013

(65) Prior Publication Data

US 2014/0260040 A1 Sep. 18, 2014

(51) Int. Cl.

| | |
|---|---|
| ***E04B 2/30*** | (2006.01) |
| ***E04B 1/76*** | (2006.01) |
| ***E04B 1/41*** | (2006.01) |

(52) U.S. Cl.

CPC ..... *E04B 1/7616* (2013.01); *E04B 1/4178* (2013.01)

(58) Field of Classification Search

CPC ..... F16B 37/16; E04B 1/4178; E04B 1/7616
USPC ..... 52/483.1, 377, 379, 506.01, 713
See application file for complete search history.

(56) References Cited

U.S. PATENT DOCUMENTS

| | | | | |
|---|---|---|---|---|
| 819,869 | A | 5/1906 | Dunlap | |
| 903,000 | A | 11/1908 | Priest, Jr. | |
| 1,014,157 | A | 1/1912 | Lewen | |
| 1,170,419 | A | 2/1916 | Coon et al. | |
| RE15,979 | E | 1/1925 | Schaefer et al. | |
| 1,794,684 | A | 3/1931 | Handel | |
| 1,936,223 | A | 11/1933 | Awbrey | |
| 1,988,124 | A | 1/1935 | Johnson | |
| 2,058,148 | A | 10/1936 | Hard | |
| 2,097,821 | A | 11/1937 | Mathers | |
| 2,280,647 | A | 4/1942 | Hawes | |
| 2,300,181 | A | 10/1942 | Spaight | |
| 2,343,764 | A | 3/1944 | Fuller | |
| 2,403,566 | A * | 7/1946 | Thorp et al. | 411/277 |

(Continued)

FOREIGN PATENT DOCUMENTS

| | | |
|---|---|---|
| CH | 279209 | 3/1952 |
| GB | 1575501 | 9/1980 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Basil Katcheves

(74) *Attorney, Agent, or Firm* — Silber & Fridman

(57) ABSTRACT

A fail-safe wall anchor for cavity walls includes a wingnut including receptors for receiving pintles of a veneer tie. Thermally insulative material is provided to inhibit transfer of heat from the veneer tie to the wall anchor. Back up structure is provided in the event the thermally insulative material fails to maintain the structural connection between the wall anchor and the veneer tie.

20 Claims, 7 Drawing Sheets

(56) References Cited

U.S. PATENT DOCUMENTS 2,413,772 A * 1/1947 Morehouse ..... 24/457
2,605,867 A 8/1952 Goodwin
2,780,936 A 2/1957 Hillberg
2,898,758 A 8/1959 Henrickson
2,909,054 A 10/1959 Phillips
2,929,238 A 3/1960 Kaye
2,966,705 A 1/1961 Massey
2,999,571 A * 9/1961 Huber ..... 411/441
3,030,670 A 4/1962 Bigelow
3,088,361 A 5/1963 Hallock
3,114,220 A 12/1963 Maddox et al.
3,121,978 A 2/1964 Reiland
3,183,628 A 5/1965 Smith
3,254,736 A * 6/1966 Gass ..... 180/68.5
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,342,005 A 9/1967 Rickards et al.
3,377,764 A 4/1968 Storch
3,478,480 A 11/1969 Swenson
3,563,131 A * 2/1971 Ridley, Sr. ..... 411/384
3,568,389 A 3/1971 Gulow
3,640,043 A 2/1972 Querfeld et al.
3,925,996 A 12/1975 Wiggill
3,964,226 A 6/1976 Hala et al.
3,964,227 A 6/1976 Hala
4,021,990 A 5/1977 Schwalberg
4,060,951 A 12/1977 Gere
4,227,359 A 10/1980 Schlenker
4,238,987 A 12/1980 Siebrecht-Reuter
4,281,494 A 8/1981 Weinar
4,305,239 A 12/1981 Geraghty
4,373,314 A 2/1983 Allan
4,382,416 A 5/1983 Kellogg-Smith
4,410,760 A 10/1983 Cole
4,424,745 A 1/1984 Magorian et al.
4,438,611 A 3/1984 Bryant
4,473,984 A 10/1984 Lopez
4,482,368 A * 11/1984 Roberts ..... 55/480
4,484,422 A 11/1984 Roberts
4,523,413 A 6/1985 Koppenberg
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A * 1/1987 Burgard ..... 411/389
4,640,848 A 2/1987 Cerdan-Diaz et al.
4,660,342 A 4/1987 Salisbury
4,688,363 A 8/1987 Sweeney et al.
4,703,604 A 11/1987 Muller
4,708,551 A 11/1987 Richter et al.
4,714,507 A 12/1987 Ohgushi
4,738,070 A 4/1988 Abbott et al.
4,757,662 A 7/1988 Gasser
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,644,889 A 7/1997 Getz
5,669,592 A * 9/1997 Kearful ..... 248/217.4
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
5,953,865 A 9/1999 Rickards
6,000,178 A 12/1999 Goodings
6,098,364 A 8/2000 Liu
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,508,447 B1 1/2003 Catani et al.
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,718,774 B2 4/2004 Razzell
6,735,915 B1 5/2004 Johnson, III
6,739,105 B2 5/2004 Fleming
6,789,365 B1 9/2004 Hohmann et al.
6,812,276 B2 11/2004 Yeager
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,918,218 B2 7/2005 Greenway
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,415,803 B2 * 8/2008 Bronner ..... 52/378
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,654,057 B2 2/2010 Zambelli et al.
7,735,292 B2 6/2010 Massie
7,748,181 B1 7/2010 Guinn
7,788,869 B2 9/2010 Voegele, Jr.
D626,817 S 11/2010 Donowho et al.
7,845,137 B2 12/2010 Hohmann, Jr.
8,037,653 B2 10/2011 Hohmann, Jr.
8,051,619 B2 11/2011 Hohmann, Jr.
8,096,090 B1 1/2012 Hohmann, Jr. et al.
8,109,706 B2 2/2012 Richards
8,122,663 B1 2/2012 Hohmann, Jr. et al.
8,154,859 B2 4/2012 Shahrokhi
8,201,374 B2 6/2012 Hohmann, Jr.
8,209,934 B2 * 7/2012 Pettingale ..... 52/712
8,215,083 B2 7/2012 Toas et al.

(56) References Cited

U.S. PATENT DOCUMENTS

| | | | | |
|---|---|---|---|---|
| 8,291,672 | B2 | 10/2012 | Hohmann, Jr. et al. | |
| 8,347,581 | B2 | 1/2013 | Doerr et al. | |
| 8,375,667 | B2 | 2/2013 | Hohmann, Jr. | |
| 8,418,422 | B2 | 4/2013 | Johnson, III | |
| 8,468,765 | B1 | 6/2013 | Kim | |
| 8,511,041 | B2 | 8/2013 | Fransen | |
| 8,516,763 | B2 | 8/2013 | Hohmann, Jr. | |
| 8,516,768 | B2 | 8/2013 | Johnson, III | |
| 8,544,228 | B2 | 10/2013 | Bronner | |
| 8,555,587 | B2 | 10/2013 | Hohmann, Jr. | |
| 8,555,596 | B2 | 10/2013 | Hohmann, Jr. | |
| 8,596,010 | B2 | 12/2013 | Hohmann, Jr. | |
| 8,609,224 | B2 | 12/2013 | Li et al. | |
| 8,613,175 | B2 | 12/2013 | Hohmann, Jr. | |
| 8,635,832 | B2 | 1/2014 | Heudorfer et al. | |
| 8,667,757 | B1 | 3/2014 | Hohmann, Jr. | |
| 8,800,241 | B2 | 8/2014 | Hohmann, Jr. | |
| 8,833,003 | B1 | 9/2014 | Hohmann, Jr. | |
| 8,839,581 | B2 | 9/2014 | Hohmann, Jr. | |
| 8,839,587 | B2 | 9/2014 | Hohmann, Jr. | |
| 8,844,229 | B1 | 9/2014 | Hohmann, Jr. | |
| 8,863,460 | B2 | 10/2014 | Hohmann, Jr. | |
| 8,881,488 | B2 | 11/2014 | Hohmann, Jr. et al. | |
| 8,898,980 | B2 | 12/2014 | Hohmann, Jr. | |
| 8,904,726 | B1 | 12/2014 | Hohmann, Jr. | |
| 8,904,727 | B1 | 12/2014 | Hohmann, Jr. | |
| 8,904,730 | B2 | 12/2014 | Hohmann, Jr. | |
| 8,904,731 | B2 | 12/2014 | Hohmann, Jr. | |
| 8,910,445 | B2 | 12/2014 | Hohmann, Jr. | |
| 8,978,330 | B2 | 3/2015 | Hohmann, Jr. | |
| 9,038,351 | B2 | 5/2015 | Hohmann, Jr. | |
| 2001/0054270 | A1 | 12/2001 | Rice | |
| 2002/0047488 | A1 | 4/2002 | Webb et al. | |
| 2002/0100239 | A1 | 8/2002 | Lopez | |
| 2003/0121226 | A1 | 7/2003 | Bolduc | |
| 2003/0217521 | A1 | 11/2003 | Richardson et al. | |
| 2004/0083667 | A1 | 5/2004 | Johnson, III | |
| 2004/0187421 | A1 | 9/2004 | Johnson, III | |
| 2004/0216408 | A1 | 11/2004 | Hohmann, Jr. | |
| 2004/0216413 | A1 | 11/2004 | Hohmann et al. | |
| 2004/0216416 | A1 | 11/2004 | Hohmann et al. | |
| 2004/0231270 | A1 | 11/2004 | Collins et al. | |
| 2005/0046187 | A1 | 3/2005 | Takeuchi et al. | |
| 2005/0279043 | A1* | 12/2005 | Bronner | 52/561 |
| 2006/0005490 | A1 | 1/2006 | Hohmann, Jr. | |
| 2006/0198717 | A1* | 9/2006 | Fuest | 411/401 |
| 2006/0242921 | A1 | 11/2006 | Massie | |
| 2006/0251916 | A1 | 11/2006 | Arikawa et al. | |
| 2007/0011964 | A1 | 1/2007 | Smith | |
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 | 5/2009 | Wobber | |
| 2009/0133357 | A1* | 5/2009 | Richards | 52/698 |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1* | 3/2011 | Hohmann, Jr. | 52/513 |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0189480 | A1 | 8/2011 | Hung | |
| 2011/0277397 | A1 | 11/2011 | Hohmann, Jr. | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. | |

FOREIGN PATENT DOCUMENTS

| | | |
|---|---|---|
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2009, 52 pages, Hauppauge, New York, United States.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Inc., Product Catalog, 44 pgs (2003).

Hohmann & Barnard, Inc., Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes Vii/Building Systems—Principles p. 721-731, 1998, 11 pages.

* cited by examiner

FAIL-SAFE ANCHORING SYSTEMS FOR CAVITY WALLS

BACKGROUND OF THE INVENTION

1. Field of the Invention

This invention relates to fail-safe anchoring systems for cavity walls. At the inner wythe, the anchoring systems provide a stud-type wall anchor with a hybrid connector portion for interlocking with a veneer anchor. The hybrid connector portion has two elements, namely, a thermoplastic portion and a metal stamping portion. Upon being subjected to a extreme heat or a fire, the thermoplastic portion is fail-prone and melts and the metal stamping portion is fail-safe and retains the veneer anchor. Under normal conditions, the thermoplastic portion provides a thermal break between the metal veneer anchor and the stud-type wall anchor.

2. Description of the Prior Art

In the past, anchoring systems have taken a variety of configurations. Where the applications included masonry backup walls, wall anchors were commonly incorporated into ladder- or truss-type reinforcements and provided wire-to-wire connections with box ties or pintle-receiving designs on the veneer side.

In the late 1980's, surface-mounted wall anchors were developed by Hohmann & Barnard, Inc., patented under U.S. Pat. No. 4,598,518 ('518). The invention was commercialized under trademarks DW-10®, DW-10-X®, and DW-10-HS®. These widely accepted building specialty products were designed primarily for drywall construction, but were also used with masonry backup walls. For seismic applications, it was common practice to use these wall anchors as part of the DW-10 Seismiclip® interlock system which added a Byna-Tie® wire formative, a Seismiclip® snap-in device—described in U.S. Pat. No. 4,875,319 ('319), and a continuous wire reinforcement.

In the dry wall application, the surface-mounted wall anchor of the above-described system has pronged legs that pierce the insulation and the wall board and rest against the metal stud to provide mechanical stability in a four-point landing arrangement. The vertical slot of the wall anchor enables the mason to have the wire tie adjustably positioned along a pathway of up to 3.625-inch (max). The interlock system served well and received high scores in testing and engineering evaluations which examined the effects of various forces, particularly lateral forces, upon brick veneer masonry construction. However, under certain conditions, the system did not sufficiently maintain the integrity of the insulation.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip® interlock system served well, but in addition to the insulation integrity problem, installations were hampered by mortar buildup interfering with pintle leg insertion.

In the late 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for disposition in a bed joint of the outer wythe. It is instructive to note that pin-point loading—that is forces concentrated at substantially a single point—developed from this design configuration. Upon experiencing lateral forces over time, this resulted in the loosening of the stud.

Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

As insulation became thicker, the tearing of insulation during installation of the pronged DW-10X® wall anchor, see supra, became more prevalent. This occurred as the installer would fully insert one side of the wall anchor before seating the other side. The tearing would occur during the arcuate path of the insertion of the second leg. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater retention of insulation integrity and less reliance on a patch.

In the past, the use of wire formatives have been limited by the mortar layer thickness which, in turn, are dictated either by the new building specifications or by pre-existing conditions, e.g. matching during renovations or additions to the existing mortar layer thickness. While arguments have been made for increasing the number of the fine-wire anchors per unit area of the facing layer, architects and architectural engineers have favored wire formative anchors of sturdier wire.

Contractors found that heavy wire anchors, with diameters approaching the mortar layer height specification, frequently result in misalignment. This led to the low-profile wall anchors of the inventors hereof as described in U.S. Pat. No. 6,279,283. However, the above-described technology did not fully address the adaption thereof to insulated inner wythes utilizing stabilized stud-type devices.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break or barrier, a concomitant loss of the insulative integrity results.

The construction of a steel-framed inner wythe of a commercial building, to which masonry veneer is attached, uses steel studs with insulation installed outboard of the steel stud framing. Steel anchors and ties attach the outer wythe to the inner wythe by screwing or bolting an anchor to a steel stud. Although steel offers many benefits, it does not provide the high insulation efficiency of timber framing and can cause the effective R-value of fiberglass batt insulation between the steel studs to fall 50 to 60%.

Steel is an extremely good conductor of heat. The use of steel anchors attached to steel framing draws heat from the inside of a building through the exterior sheathing and insulation, towards the exterior of the masonry wall. In order to maintain high insulation values, a thermal break or barrier is needed between the steel framing and the outer wythe. This is achieved by the present invention through the use of high-strength polymeric components which have low thermal conductivity. Removing the steel portions of the anchor at specific locations and replacing the steel with a high-strength polymeric material with a lower thermal conductivity than steel, causes a thermal break and significantly reduces the transfer of heat.

In the course of prosecution, wall anchor patents indicated by an asterisk on the tabulation below, came to the attention of the inventor and are believed to be relevant in this discussion of the prior art. A more extensive list of patents known to the inventor is included in the Information Disclosure Statement. Thereafter and in preparing for this disclosure, the additional patents which became known to the inventors are discussed further:

| Pat. | Inventor | Issue Date |
|---|---|---|
| 2,058,148* | Hard | Oct. 20, 1936 |
| 2,966,705* | Massey | Jan. 3, 1961 |
| 3,377,764 | Storch | Apr. 16, 1968 |
| 4,021,990* | Schwalberg | May 10, 1977 |
| 4,305,239* | Geraghty | Dec. 15, 1981 |
| 4,373,314 | Allan | Feb. 15, 1983 |
| 4,438,611* | Bryant | Mar. 27, 1984 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,392,581 | Hatzinikolas, et. al. | Feb. 28, 1995 |
| 5,408,798 | Hohmann | Apr. 25, 1995 |
| 5,456,052 | Anderson et al. | Oct. 10, 1995 |
| 5,816,008 | Hohmann | Oct. 6, 1998 |
| 6,209,281 | Rice | Apr. 3, 2001 |
| 6,279,283 | Hohmann et al. | Aug. 28, 2001 |
| 7,415,803 | Bronner | Aug. 26, 2008 |
| 8,037,653 | Hohmann, Jr. | Oct. 18, 2011 |

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968 discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 discloses a vertical angle iron with one leg adapted for attachment to a stud and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989 discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,875,319—R. Hohmann—Issued Oct. 24, 1989 discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995 discloses a cavity-wall anchor having a conventional tie wire for mounting in the brick veneer and an L-shaped sheetmetal bracket for mounting vertically between side-by-side blocks and horizontally atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 6, 1998 discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001 discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 discloses a low-profile wall tie primarily for use in renovation construction where in order to match existing mortar height in the facing wythe a compressed wall tie is embedded in the bed joint of the brick veneer.

U.S. Pat. No. 7,415,803—Bronner—Issued Aug. 26, 2008 discloses a double-wingnut anchor system and method for connecting an anchor shaft extending from the backup wall to a wire tie extending from a veneer wall. The wingnut houses the wire tie legs and is independently rotatable to obtain the desired angular position.

U.S. Pat. No. 8,037,653—Hohmann, Jr.—Issued Oct. 18, 2011 discloses a dual seal anchoring system for insulated cavity walls. The stud anchor has a dual-diameter barrel with thermally-isolating seals.

None of the above provide the high-strength, supported stud-type wall anchor or anchoring systems utilizing these devices of this invention. As will become clear in reviewing the disclosure which follows, the cavity wall structures benefit from the recent developments described herein that lead to solving the problems of thermal conductivity by providing an in-cavity thermal break and of anchor integrity by having a hybrid wall anchor with both a failure-prone and a fail-safe receptor portions. The anchoring systems hereof combine various wall anchors for self-leveling installation and include reinforcement for seismic protection.

SUMMARY

In general terms, an embodiment of the invention disclosed hereby is an anchoring system for use in a cavity wall. The anchoring system has a steel stud-type wall anchor and a wire formative veneer tie. The steel stud has an elongated dual-diameter barrel body with a driven self-drilling tip and a receptor-bearing hybrid wing nut.

The wing nut has both a failure-prone portion and a fail-safe portion. The failure-prone portion is a thermoplastic structure formed by overmolding or undermolding a metal armature. When, in the event of a fire, the temperature exceeds the melting point of the thermoplastic, the veneer tie remains interlocked with the metal armature which becomes a fail-safe wall anchor. In normal use and under normal conditions, the hybrid wing nut provides an in-cavity thermal break between the veneer and the backup wall.

In the molding process, the overmolded embodiment is first discussed. Here exemplary of the device, the armature has a shaftway the central axis of which is co-extensive with that of the stud-type wall anchor and has wings normal to central axis with receptors therethrough to accommodate pintles of the veneer tie. Projections on the armature position the armature during molding so that the receptors are coated with thermoplastic material and so that there is no metal-to-metal contact.

In the molding process, the undermolded product is next discussed. Here the metal receptor portions is banded or surrounds the thermoplastic material and only makes metal-to-metal contact in the fail-safe mode of operation.

The structure taught by this invention overcomes both the problems of thermal conductivity by providing an in-cavity thermal break and of failure under extreme temperature conditions. The pin-point loading as described in the Background of the Invention, supra, is overcome by full body support throughout the drywall, the air/vapor barrier, and the insulation. The vapor seal, when the stud-type anchor is fully driven into place provides a seal over the insertion point into the air/vapor barrier. The insulation seal, when the stud-type anchor is fully driven into place, provides a seal over the opening of an anchor-receiving channel and thereby preserves the insulation integrity. Similarly, the insertion seal, when the anchor is fully driven into place, provides a seal at the insertion point in the inner wythe. The polymeric seals provide a thermal break between the inner and outer wythe and thereby maintain insulation R-values. The vapor seal and the larger barrel of the anchor, when installed, completely fill the anchor receiving channel and stabilize the wall anchor. The wall anchor is clamped in place by the seals. The anchor includes either two or three seals.

The stud-type anchor is disclosed as operating with a variety of veneer ties and drivers, each providing for different applications. A modified Byna-Tie® wire formative with a swaged side leg in the insertion portion expands the utility of the system to seismic applications and accommodates a wire reinforcement in the outer wythe. a tie with a U-shaped rear leg provides for accommodating the driver head at whatever angle it is at when fully driven into place. A tie with an angled rear leg provides for self-leveling as between the stud position and the bed joint height. A wingnut driver accommodates a tie with pintle side legs and provides for angular adjustment.

It is an object of the present invention to provide new and novel anchoring systems for cavity walls, which systems provide a fail-safe mode under extreme conditions and an in-cavity thermal break under normal conditions.

It is yet another object of the present invention to provide adjustability of the veneer anchor to compensate for slight angular and height misalignments.

It is a further object of the present invention to provide an anchoring system which precludes disengagement under seismic and other severe environmental conditions.

It is another object of the present invention to provide an anchoring system that maintains high insulation values.

It is a feature of the present invention that the wall anchor has a dual-diameter barrel with a self-drilling screw tip which facilitates installation.

It is another feature of the present invention that the wall anchor has high-strength polymeric components that provide for a thermal break in the cavity.

It is yet another feature of the present invention that the anchor system has a hybrid wingnut with receptors for the pintles of a veneer tie.

It is still yet another feature of the present invention that the hybrid wingnut is readily fabricated by overmolding or undermolding.

Other objects and features of the present invention will become apparent upon reviewing the drawing and reading the detailed description which follows.

BRIEF DESCRIPTION OF THE DRAWINGS

In the following drawings, the same parts in the various views are afforded the same reference designators.

DETAILED DESCRIPTION

Figure 1:
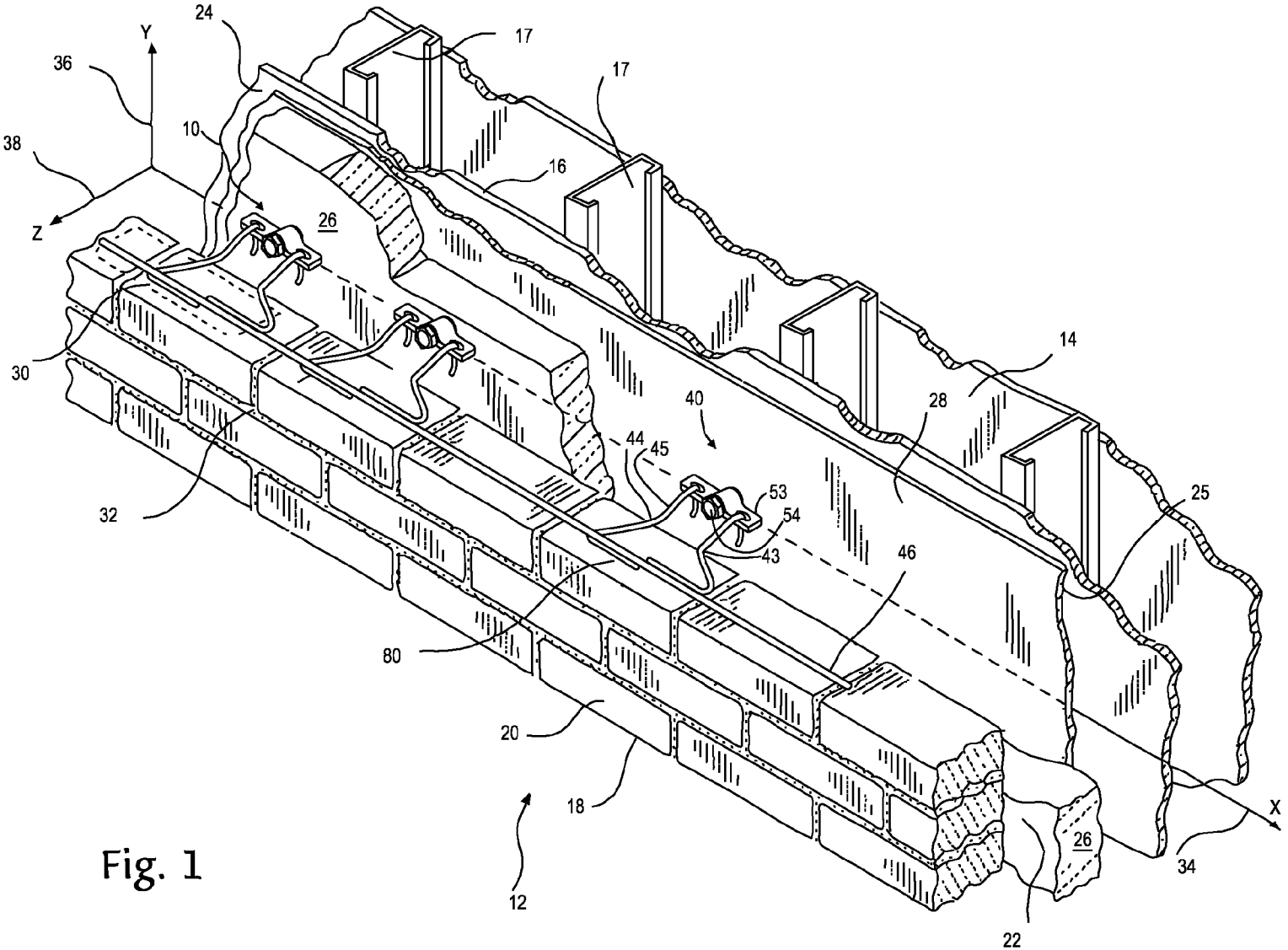
FIG. 1 shows a first embodiment of this invention and is a perspective view of an anchoring system as applied to a cavity wall with an inner wythe of an insulated dry wall construction and an outer wythe of brick.
Figure 2:
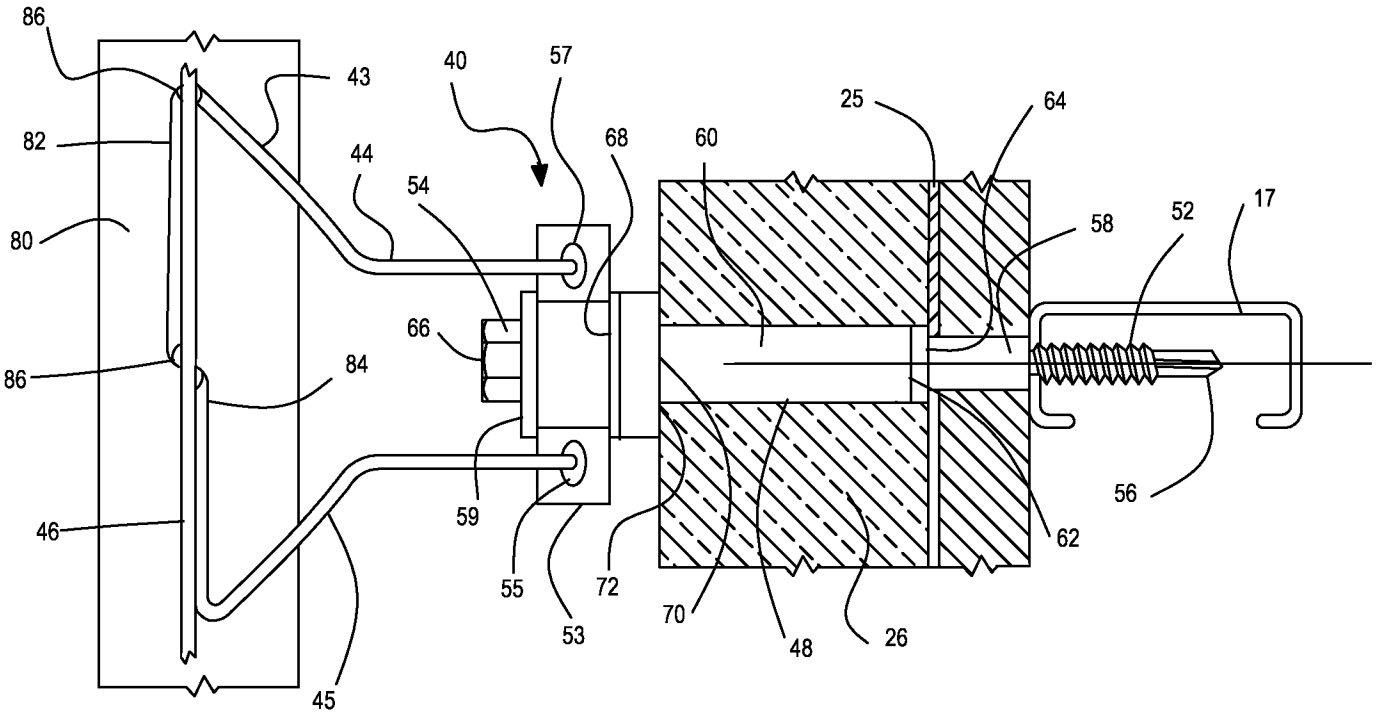
FIG. 2 is a cross-sectional view of FIG. 1 taken along an xz-plane including the longitudinal axis of the wall anchor, and showing the hybrid wingnut of the wall anchor.
Figure 3:
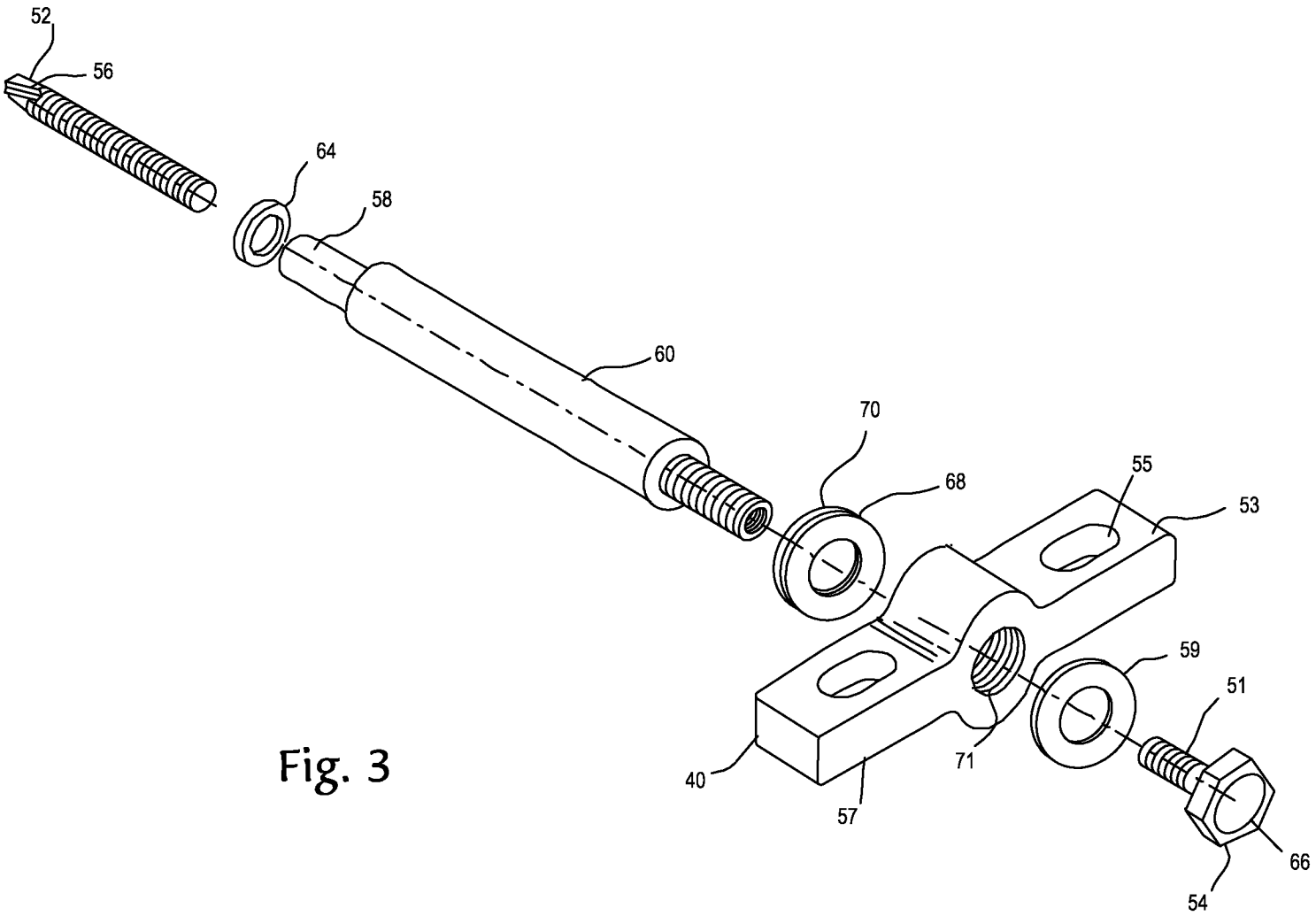
FIG. 3 is an exploded view of the wall anchor showing the dual-barrel configuration and the overmolded hybrid wingnut of this invention.

Before entering into the Detailed Description, several terms which will be revisited later are defined. These terms are relevant to discussions of innovations introduced by the improvements of this disclosure that overcome the deficits of the prior art devices.

In the embodiments described hereinbelow, the inner wythe is provided with insulation. In the dry wall construction, shown herein, the insulation is applied to the outer surface thereof. Recently, building codes have required that after the anchoring system is installed and, prior to the inner wythe being closed up, that an inspection be made for insulation integrity to ensure that the insulation prevents infiltration of air and moisture. The term as used herein is defined in the same sense as the building code in that, "insulation integrity" means that, after the installation of the anchoring system, there is no change or interference with the insulative properties and concomitantly that there is substantially no change in the air and moisture infiltration characteristics.

Anchoring systems for cavity walls are used to secure veneer facings to a buildings and overcome extreme temperature conditions, seismic and other forces, i.e. fire, wind shear, etc. In the past, some systems have experienced failure. Here, the term "hybrid wingnut" is defined as a two anchor component wherein each component has a specific function. The insulative function is produced using an anchor of nonthermally conductive material such as a thermoplastic and further the fail-safe function is achieved using a metal anchor. When the hybrid wingnut is produced by overmolding, the metal portion acts as an "armature" defined for our purposes as an underlying element around or upon which the mold is structured. When the hybrid wingnut is produced by undermolding, the metal anchor forms a framework or a band within which the molded portion resides.

In general terms, the dual function of the hybrid wingnut creates a desirable redundancy and, when the thermoplastic anchor melts at high temperatures, the veneer—in this case a brick veneer—is left safely attached to the backup wall by the metal anchor.

In the detailed description which follows, the veneer ties and reinforcements are wire formatives. The hybrid wingnut of the wall anchor provides an in-cavity thermal break attributable to the use of high-strength polymeric material.

Referring now to FIGS. 1 through 6, the first embodiment shows an anchoring system suitable for seismic zone applications. This anchoring system, discussed in detail hereinbelow, has a wall anchor, an interengaging veneer tie, and a veneer (outer wythe) reinforcement. For the first embodiment, a cavity wall having an insulative layer of 4.0 inches (approx.) and a total span or 4.75 inches (approx.) is chosen as exemplary.

The anchoring system for cavity walls is referred to generally by numeral 10. A cavity wall structure 12 is shown having an inner wythe or drywall backup 14 with sheetrock or wallboard 16 mounted on metal studs or columns 17 and an outer wythe or facing wall 18 of brick 20 construction. Inner wythes constructed of masonry materials or wood framing (not shown) are also applicable. Between the inner wythe 14 and the outer wythe 18, a cavity 22 is formed. The cavity 22 has attached to the exterior surface 24 of the inner wythe 14 an air or air-vapor barrier 25 and insulation 26. The air or air-vapor 25 and the wallboard 16 together form the exterior layer 28 of the inner wythe 14, which exterior layer 28 has the insulation 26 disposed thereon.

Successive bed joints 30 and 32 are substantially planar and horizontally disposed and, in accord with current building standards, are 0.375-inch (approx.) in height. Selective ones of bed joints 30 and 32, which are formed between courses of bricks 20, are constructed to receive therewithin the insertion portion of the veneer anchor hereof. Being threadedly mounted in the inner wythe, the wall anchor is supported thereby and, as described in greater detail herein below, is configured to minimize air and moisture penetration around the wall anchor/inner wythe interface.

Figure 4:
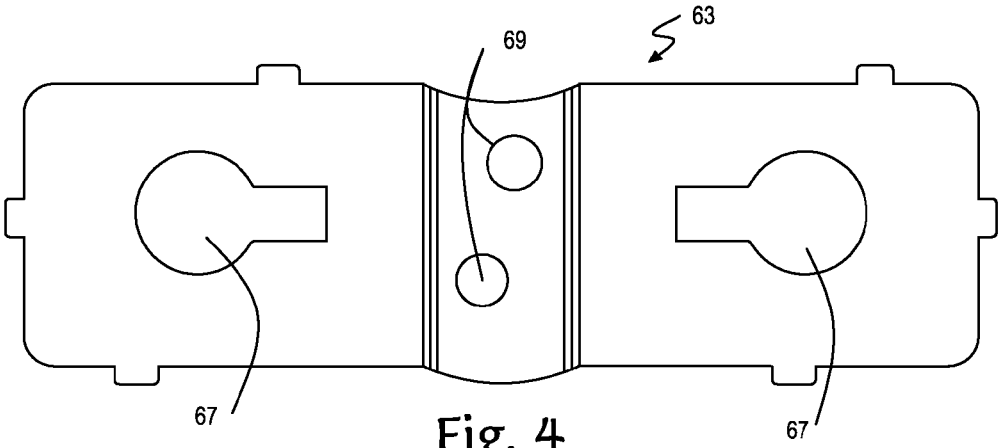
FIG. 4 is a side elevational view of the metal stamping used to form the wall anchor armature shown prior to overmolding.
Figure 5:
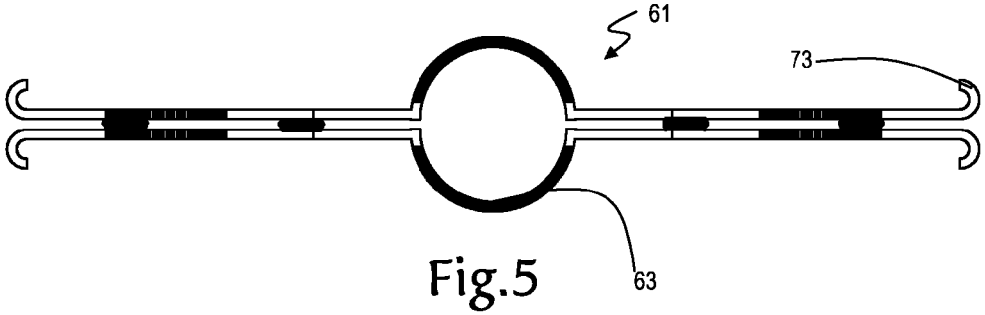
FIG. 5 is a top plan view of the wall anchor armature utilizing two metal stampings shown in FIG. 4 and providing a fail-safe wall anchor.
Figure 6:
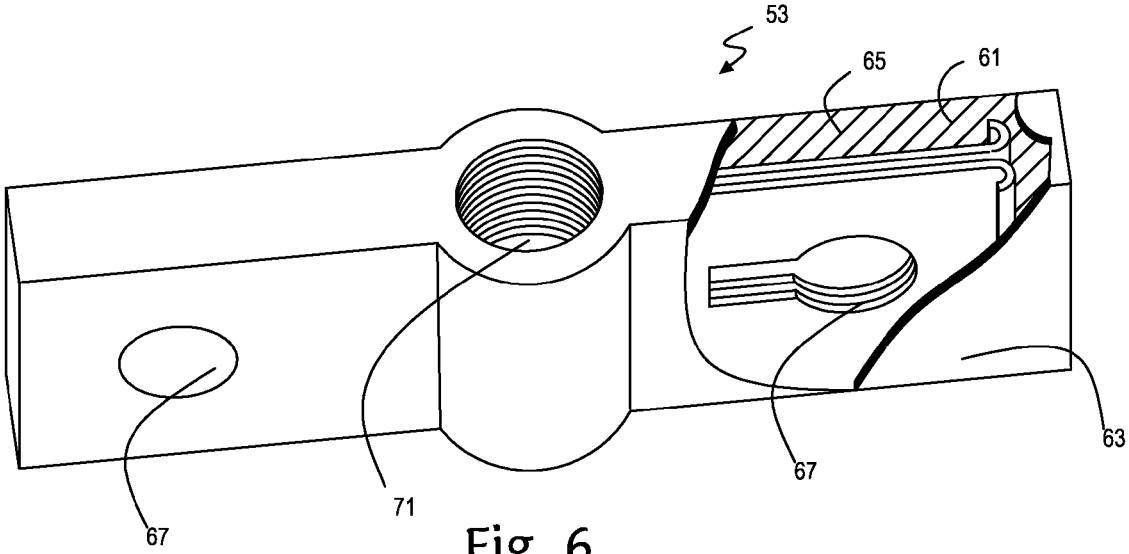
FIG. 6 is a perspective view of the hybrid wingnut wherein a thermoplastic is molded over the fail-safe wall anchor of FIG. 5 and is partially broken away to show the fail-safe wall anchor.

For purposes of discussion, the cavity surface 24 of the inner wythe 14 contains a horizontal line of x-axis 34 intersecting vertical line or y-axis 36. A horizontal line or z-axis 38, normal to the xy-plane, passes through the coordinate origin formed by the intersecting x- and y-axes. A wall anchor 40 is shown with a hybrid wingnut component 53. The hybrid component 53 is constructed of a thermoplastic overmold consisting of an insulative high-strength polymeric material, such as polyvinyl chloride, that provides a nonconductive pathway through the cavity wall 12. The nonconductive material is essential in maintaining maximum insulation R-values by providing an in-cavity thermal break between the metal studs 17 and the outer wythe 18. A steel armature 61, shown in FIGS. 4, 5, and 6, is a pair of metal stamping 63 constructed from stainless steel, carbon steel, galvanized steel, zinc cast steel, or the like. The armature 61, upon a fire melting away the thermoplastic covering 65 acts as a backup, fail-safe wall anchor and may also be referred to herein as an armature-anchor 61.

The wall anchor 40, while shown as an assemblage of several distinct parts, may be manufactured as a unitary structure. The veneer tie 44 is a box Byna-Tie® device manufactured by Hohmann & Barnard, Inc., Hauppauge, N.Y. 11788. The veneer tie 44 is a wire formative with pintle connectors 43 and 45 that engage the apertures or receptors 55 and 57 in the wingnut 53 of the anchor 40. The veneer tie 44 is shown in FIG. 1 as being emplaced on a course of bricks 20 in preparation for embedment in the mortar of bed joint 30. In this embodiment, the system includes a wire or outer wythe reinforcement 46, a wall anchor 40 and a veneer tie 44. The wire reinforcement 46 is constructed of a wire formative.

In the overmolding process, molten thermoplastic flows though receptors 67, FIG. 4, to form the receptors 55 and 57 and apertures 69 to form interior thread 71. Projections 73 properly position armature 61 within the mold to create the hybrid wingnut component 53.

At intervals along a horizontal surface 24, wall anchors 40 are positioned on surface 24 so that the longitudinal axis of wall anchor 40 extends from a driven end 52 to a driver end 54. The driven end 52 is constructed with a self-drilling screw portion 56.

Contiguous with screw portion 56 is a dual-diameter barrel with a smaller diameter barrel or shaft portion 58 toward the driven end 52 and a larger diameter barrel or shaft portion 60 toward the driver end 54. At the juncture of barrel portions 58 and 60, a flange 62 is formed and a stabilizing neoprene fitting or internal seal 64 is emplaced thereat. When fully driven into column 17 the screw 56 and barrel portion 58 wall anchor 40 pierces sheetrock or wallboard 16 and air or air-vapor barrier 25. The channel seal 64 covers the insertion point or installation channel precluding air and moisture penetration therethrough and maintaining the integrity barrier 25.

At the driving end 54, a driver portion 66 adjoins larger diameter barrel or shaft portion 60 forming a flange 68 therebetween and another stabilizing neoprene fitting or external seal 70 is emplaced threat. Upon installation into rigid insulation, the larger barrel portion 60 is forced into a press fit relationship with anchor-receiving channel 48. Stabilization of this stud-type wall anchor 40 is attained by barrel portion 60 and neoprene fitting 64 completely filling the channel 48 with external neoprene fitting 70 capping the opening 72 of channel 48 into cavity 22 and clamping wall anchor 40 in place. This arrangement does not leave any end play or wiggle room for pin-point loading of the wall anchor and therefore does not loosen over time. With stabilizing fitting or external seal 70 in place, the insulation integrity within the cavity wall is maintained. The driver portion 66 is capable of being driven using a conventional chuck and, after being rotated to align with the bed joint 30, the wingnut 53 is locked in place. The wingnut 53 has two apertures 55 and 57 for accommodating the veneer tie and has the effect of spreading stresses experienced during use and further reducing pin-point loading as opposite force vectors cancel one another. In producing wall anchor 48, the length of the smaller diameter barrel 58 less the internal seal 64 height is dimensioned to match the external layer 28 thickness. Similarly, the length of the larger diameter barrel 60 plus the internal seal 64 height is dimensioned to match the insulation thickness.

In this embodiment, the driver portion 66 is a bolt 51 and a washer 59 that secures a wingnut 53. The two apertured ends 55 and 57 of the wingnut 53 receive the veneer tie 44. The wingnut 53 is angularly adjusted to ensure proper alignment of the veneer tie 44. The veneer tie 44 is a wire formative having two pintle leg portions 43 and 45. The leg portions 43 and 45 are inserted into the apertured ends 55 and 57 of the wingnut 53 and extend to and, at the front portion thereof, are part of insertion portion 80 which is shown installed into bed joint 30. The insertion portion 80 is constructed with two parallel front legs 82 and 84 adjoining leg portions 43 and 45, respectively, and housing therebetween wire reinforcement 46. At the juncture of side leg 43 and front leg 82, a swaged area 86 is shown for further accommodating wire reinforcement 46.

Referring now to FIGS. 7 through 10, the second embodiment shows an anchoring system suitable for seismic zone applications. This anchoring system, discussed in detail hereinbelow, has a wall anchor, an interengaging veneer tie, and a veneer (outer wythe) reinforcement. Similar to the first embodiment, the second embodiment has a cavity wall having an insulative layer of 4.0 inches (approx.) and a total span or 4.75 inches (approx.) is chosen as exemplary; however, here the undermolded hybrid wingnut is employed. In the description which follows, reference designators used for similar parts to those in the first embodiment are "100" digits higher. For example, metal studs 17 in the first embodiment find similar columns 117 in the second embodiment.

The anchoring system for cavity walls is referred to generally by numeral 110. A cavity wall structure 112 is shown having an inner wythe or drywall backup 114 with sheetrock or wallboard 116 mounted on metal studs or columns 117 and an outer wythe or facing wall 118 of brick 120 construction. Inner wythes constructed of masonry materials or wood framing (not shown) are also applicable. Between the inner wythe 114 and the outer wythe 118, a cavity 122 is formed. The cavity 122 has attached to the exterior surface 124 of the inner wythe 114 an air or air-vapor barrier 125 and insulation 126. The air or air-vapor 125 and the wallboard 116 together form the exterior layer 128 of the inner wythe 114, which exterior layer 128 has the insulation 126 disposed thereon.

Successive bed joints 130 and 132 are substantially planar and horizontally disposed and, in accord with current building standards, are 0.375-inch (approx.) in height. Selective ones of bed joints 130 and 132, which are formed between courses of bricks 120, are constructed to receive therewithin the insertion portion of the veneer anchor hereof. Being threadedly mounted in the inner wythe, the wall anchor is supported thereby and, as described in greater detail herein below, is configured to minimize air and moisture penetration around the wall anchor/inner wythe interface.

Figure 8:
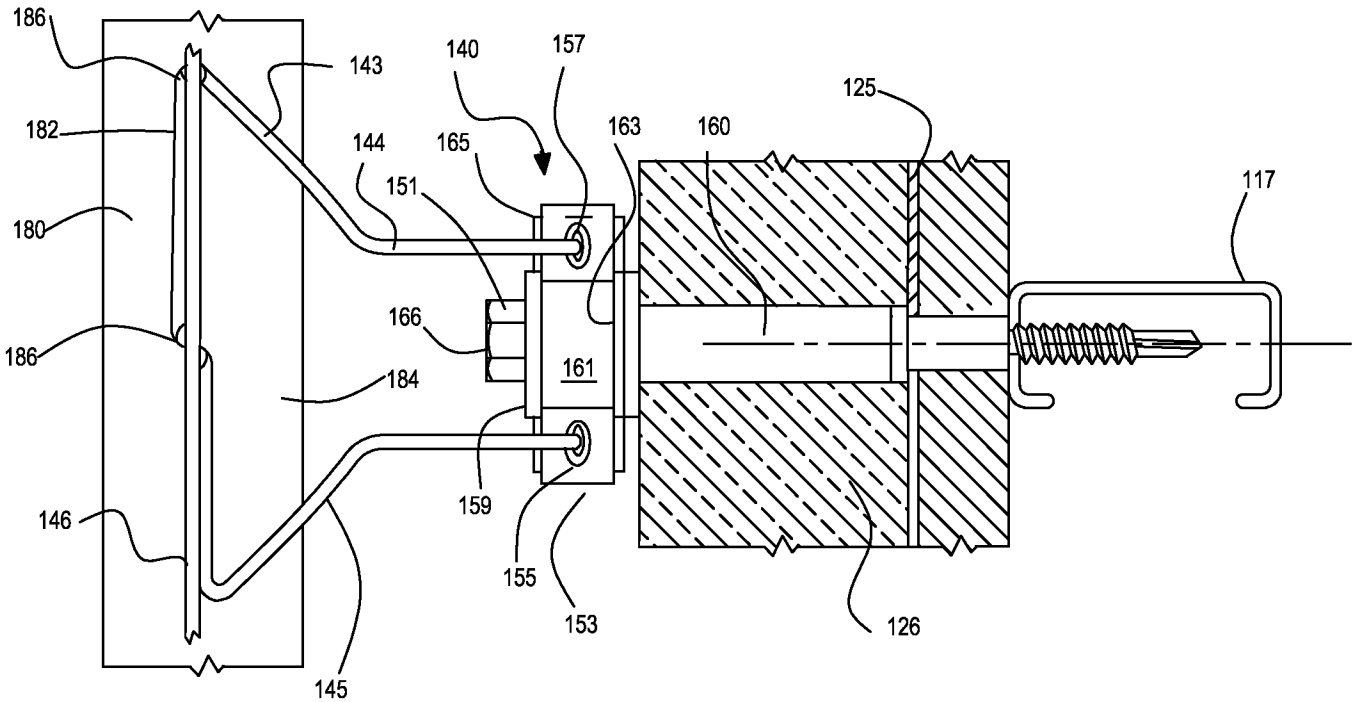
FIG. 8 is a cross-sectional view of the anchoring system of FIG. 7.
Figure 9:
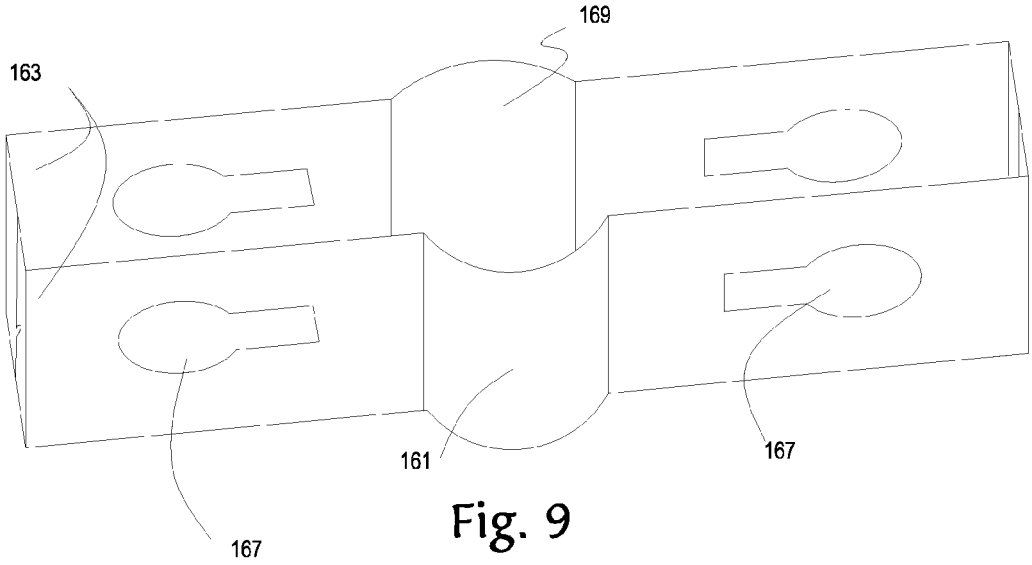
FIG. 9 is a perspective view of a fail-safe metal band for an undermolded hybrid wingnut; and, FIG. 10 is a perspective view of the hybrid wingnut wherein a thermoplastic is molded under the fail-safe anchor of FIG. 9.
Figure 10:
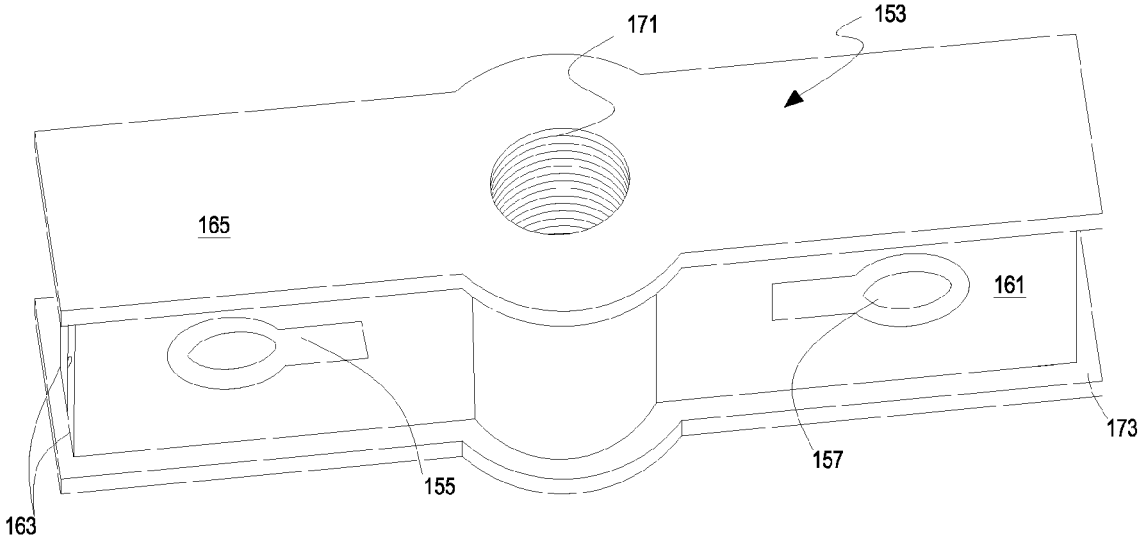

A wall anchor 140 is shown with a hybrid wingnut component 153. The hybrid component 153 is constructed of a thermoplastic undermold consisting of an insulative high-strength polymeric material, such as polyvinyl chloride, that provides an in-cavity thermal break interrupting the prior conductive pathway through the cavity wall 112. The non-conductive material is in essence maintains the maximum insulation R-values through this in-cavity thermal break between the metal studs 117 and the outer wythe 118. A steel anchor band 161, shown in FIGS. 8, 9, and 10, is a pair of snap-fit metal stampings 163 constructed from stainless steel, carbon steel, galvanized steel, zinc cast steel, or the like. The steel anchor band 161, upon a fire melting away the undermolded thermoplastic anchor 165 acts as a backup, fail-safe wall anchor and may also be referred to herein as an exterior anchor 161. The wall anchor 140, while shown as a unitary structure 160 may be an assemblage of several distinct parts.

Figure 7:
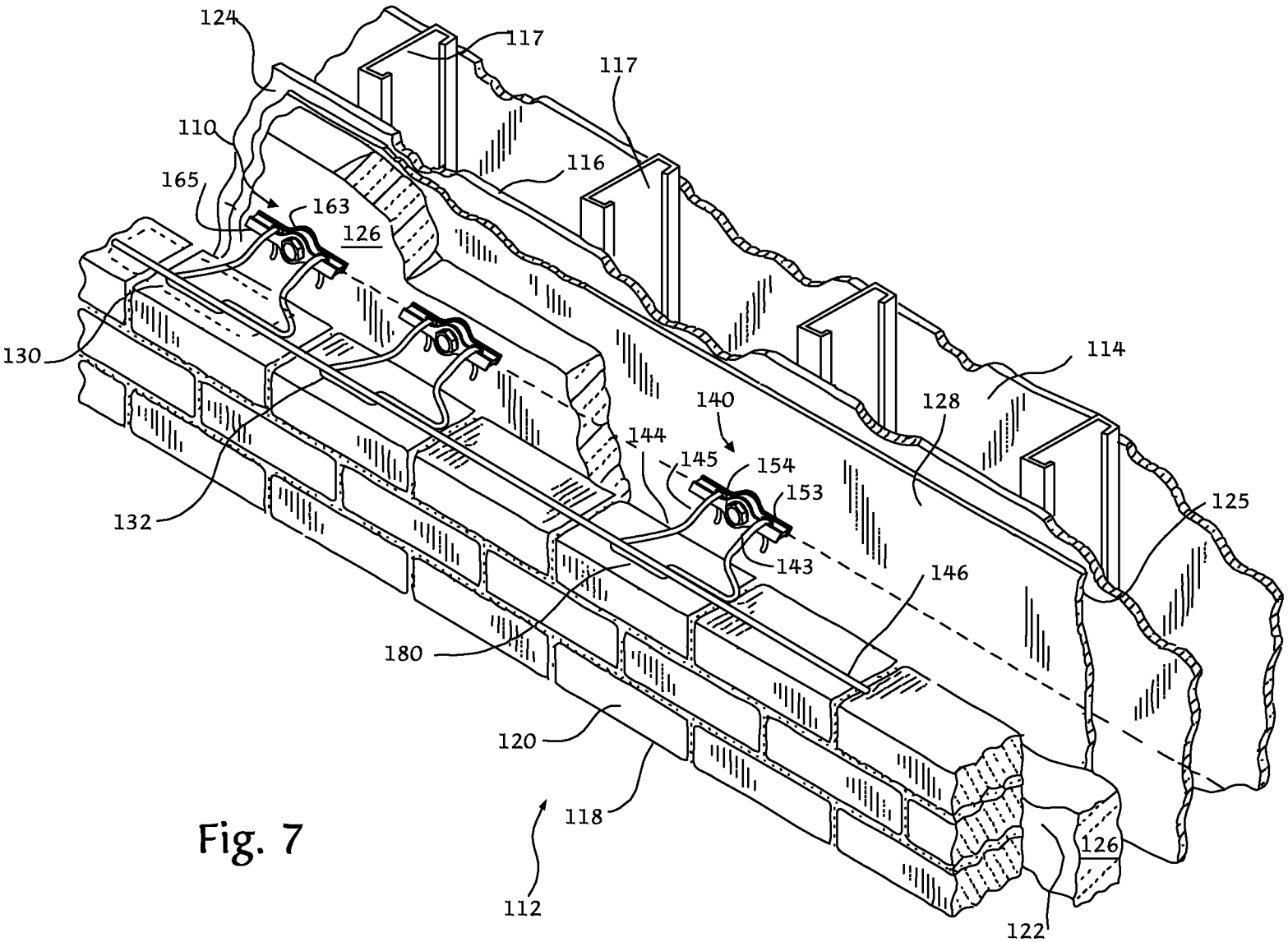
FIG. 7 is a perspective view of an anchoring system similar to FIG. 1, but utilizing an undermolded hybrid wingnut and a unitary stud-type wall anchor.

The veneer tie 144 is a box Byna-Tie® device manufactured by Hohmann & Barnard, Inc., Hauppauge, N.Y. 11788. The veneer tie 144 is a wire formative with pintle connectors 143 and 145 that engage the apertures or receptors 155 and 157 in the wingnut 153 of the anchor 140. The veneer tie 144 is shown in FIG. 7 as being emplaced on a course of bricks 120 in preparation for embedment in the mortar of bed joint 130. In this embodiment, the system includes a wire or outer wythe reinforcement 146, a wall anchor 140 and a veneer tie 144. The wire reinforcement 146 is constructed of a wire formative.

In the undermolding process, molten thermoplastic flows though receptors 167 to form the receptors 155 and 157 and apertures 169 to form interior thread 171. Projections 173 properly position the metal anchor band 161 to form the hybrid wingnut component 153. While the fail-safe band 161 is described as part of this process, the component may be assembled to the thermoplastic anchor 165 apart from the molding process.

In this embodiment, the wingnut 153 is secured to the driver portion 166 of the stud-type anchor body by a bolt 151 and a washer 159. The two apertured ends 155 and 157 of the wingnut 153 receive the veneer tie 144. The wingnut 153 is angularly adjusted to ensure proper alignment of the veneer tie 144. The metal band or framework 163 surrounding the thermoplastic molded portion 165 enhances the tension and compression rating of the hybrid wingnut 153. The veneer tie 144 is a wire formative having two pintle leg portions 143 and 145. The leg portions 143 and 145 are inserted into the thermoplastic apertured ends 155 and 157 of the wingnut 153. The veneer tie 144 extends to and, at the front portion thereof, are part of insertion portion 180 which is shown installed into bed joint 130. The insertion portion 180 is constructed with two parallel front legs 182 and 184 adjoining leg portions 143 and 145, respectively, and housing therebetween wire reinforcement 146. At the juncture of side leg 143 and front leg 182, a swaged area 186 is shown for further accommodating wire reinforcement 146.

The following attributes of the anchoring system hereof have been described in related applications and are re-iterated here for purposes of clarity and completeness. At intervals along a horizontal surface 24, wall anchors 40 are positioned on surface 24 so that the longitudinal axis of wall anchor 40 extends from a driven end 52 to a driver end 54. The driven end 52 is constructed with a self-drilling screw portion 56.

Contiguous with screw portion 56 is a dual-diameter barrel with a smaller diameter barrel or shaft portion 58 toward the driven end 52 and a larger diameter barrel or shaft portion 60 toward the driver end 54. At the juncture of barrel portions 58 and 60, a flange 62 is formed and a stabilizing neoprene fitting or internal seal 64 is emplaced thereat. When fully driven into column 17 the screw 56 and barrel portion 58 wall anchor 40 pierces sheetrock or wallboard 16 and air or air-vapor barrier 25. The channel seal 64 covers the insertion point or installation channel precluding air and moisture penetration therethrough and maintaining the integrity barrier 25.

At the driving end 54, a driver portion 66 adjoins larger diameter barrel or shaft portion 60 forming a flange 68 therebetween and another stabilizing neoprene fitting or external seal 70 is emplaced threat. Upon installation into rigid insulation, the larger barrel portion 60 is forced into a press fit relationship with anchor-receiving channel 48. Stabilization of this stud-type wall anchor 40 is attained by barrel portion 60 and neoprene fitting 64 completely filling the channel 48 with external neoprene fitting 70 capping the opening 72 of channel 48 into cavity 22 and clamping wall anchor 40 in place. This arrangement does not leave any end play or wiggle room for pin-point loading of the wall anchor and therefore does not loosen over time. With stabilizing fitting or external seal 70 in place, the insulation integrity within the cavity wall is maintained. The driver portion 66 is capable of being driven using a conventional chuck and, after being rotated to align with the bed joint 30, the wingnut 53 is locked in place. The wingnut 53 has two apertures 55 and 57 for accommodating the veneer tie and has the effect of spreading stresses experienced during use and further reducing pin-point loading as opposite force vectors cancel one another. In producing wall anchor 48, the length of the smaller diameter barrel 58 less the internal seal 64 height is dimensioned to match the external layer 28 thickness. Similarly, the length of the larger diameter barrel 60 plus the internal seal 64 height is dimensioned to match the insulation thickness.

In the above description of fail-safe anchoring systems for cavity walls of this invention various configurations are described and applications thereof in corresponding settings are provided. Because varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. Thus minor changes may be made without departing from the spirit of the invention.

What is claimed is:

1. A fail-safe wall anchor for cavity walls, the wall anchor for engaging a veneer tie, the wall anchor comprising:

a stud-type anchor having an elongated body with a driving end and a driven end;

a hybrid wingnut disposed on the driving end of the stud-type anchor body, the hybrid wingnut further comprising:

a fail-safe wingnut portion with a shaftway therethrough for the stud-type anchor and with receptors for receiving the veneer tie;

a fail-prone wingnut portion of molded thermoplastic with a shaftway therethrough for the stud-type anchor body and receptors for receiving the veneer tie, the fail-prone wingnut portion melting upon extreme temperature conditions and the veneer tie being securely held by the fail-safe wingnut portion, the fail-prone wingnut portion under normal operating conditions providing an in-cavity thermal break between the veneer tie and the wall anchor, wherein the fail-safe wingnut portion is of stamped metal and forms a frame, the fail-prone wingnut portion being positioned within the frame, thereby forming an exterior fail-safe wall anchor and an interior fail-prone wall anchor; and, a bolt securing the hybrid wingnut to the stud-type anchor body.

2. A fail-safe anchor as in claim 1, wherein the fail-prone wingnut portion is formed by undermolding.

3. A fail-safe anchor as in claim 2, wherein the driving end of the stud-type anchor body is threaded, and, during undermolding, mating threads are formed on the fail-prone wingnut portion.

4. A fail-safe anchor as in claim 1, wherein the fail-prone wingnut portion extends into the shaftway of the fail-safe wingnut portion.

5. A fail-safe anchor as in claim 1, wherein the stud-type anchor is free from thermoplastic coating.

6. A fail-safe wall anchor for cavity walls, the wall anchor for engaging pintles of a veneer tie, the wall anchor comprising:

a stud-type anchor having an elongated body with a driving end and a driven end;

a hybrid wingnut disposed on the driving end of the stud-type anchor, the hybrid wingnut having a central opening therethrough for disposition thereof on the stud-type anchor, the hybrid wingnut further comprising:

a first wingnut portion of fire-resistant material with receptors for accepting the pintles;

a second wingnut portion of thermally insulative material with receptors for accepting the pintles, the receptors thereof being co-extensive with the receptors of the first wingnut portion, the second wingnut portion having a thickness selected to provide a thermal barrier between the first wingnut portion and a veneer tie attached to the hybrid wingnut, wherein the first wingnut portion is formed from a pair of metal stampings and is secured to the stud-type anchor by attaching hardware threadedly mounted to the stud-type anchor.

7. A fail-safe wall anchor as in claim 6, wherein the first wingnut portion is of stamped metal and forms an armature upon which the second wingnut portion is overmolded, thereby forming a first wall anchor within a second wall anchor.

8. A fail-safe wall anchor as in claim 7, wherein the driving end of the stud-type anchor body is threaded, and the armature has a plurality of apertures leading to the shaftway allowing, during overmolding, for the flow of molten thermoplastic to form mating threads with those of the stud-type anchor body.

9. A fail-safe wall anchor as in claim 7 wherein the metal of the armature is selected from a group consisting of stainless steel, carbon steel, galvanized steel, and zinc cast steel.

10. A fail-safe anchor as in claim 6 wherein the metal stampings are constructed of a metal selected from a group consisting of stainless steel, carbon steel, galvanized steel, and zinc cast steel.

11. A fail-safe anchor as in claim 10 wherein the driving end of the stud-type anchor is threaded and the first wingnut portion has a plurality of apertures leading to the central opening therethrough allowing, during overmolding, for the flow of molten thermoplastic to form mating threads with those of the stud-type anchor.

12. A fail-safe anchor as in claim 6 wherein the second wingnut portion is overmolded from a thermoplastic disposed atop the first wingnut portion.

13. A fail-safe anchor as in claim 6 wherein the metal stampings increase the tension and compression rating of the wall anchor.

14. A fail-safe anchor as in claim 6 wherein the second wingnut portion has a thermoplastic body and is engirded by the first wingnut portion, the first wingnut portion comprising a metal, fire-resistant band.

15. A fail-safe anchor as in claim 14 wherein the band is constructed of a metal selected from a group consisting of stainless steel, carbon steel, galvanized steel, and zinc cast steel.

16. A fail-safe anchor as in claim 15 wherein the second wingnut portion is formed by undermolding.

17. A fail-safe wall anchor for cavity walls the cavity wall having an inner wythe and an outer wythe with a cavity therebetween, the wall anchor for interengaging with pintles of a veneer tie, the wall anchor comprising:

a stud-type body of unitary construction having a driven end for self-tapping into metal columns and a driving end, the driving end extending, upon installation into the cavity of the cavity wall; and, a hybrid wingnut providing redundant connectivity for the veneer tie by having a thermoplastic receptor for an in-cavity thermal break and a metal receptor coextensive therewith for fail-safe operation at exceedingly high temperatures, the metal receptor comprising a shaftway extending therethrough for receiving the stud-type body, wherein the thermoplastic receptor extends into the shaftway of the metal receptor.

18. A fail-safe wall anchor as in claim 17 wherein the hybrid wingnut utilizes the metal receptor as an armature for overmolding the thermoplastic receptor thereon.

19. A fail-safe wall anchor as in claim 18 wherein the metal receptor is constructed of a metal selected from a group consisting of stainless steel, carbon steel, galvanized steel, and zinc cast steel.

20. A fail-safe anchor as in claim 18 wherein the metal receptor increases the tension and compression rating of the wall anchor.

* * * * *